United States Patent [19]

Kraeutler

[11] Patent Number: 4,718,471

[45] Date of Patent: Jan. 12, 1988

[54] FIXING AND PROTECTIVE HOUSING FOR THE DRIVE MEANS OF A CONCERTINA TYPE DOOR

[75] Inventor: Bernard Kraeutler, Dunieres, France

[73] Assignee: Nergeco, Dunieres, France

[21] Appl. No.: 795,610

[22] Filed: Nov. 6, 1985

[30] Foreign Application Priority Data

Nov. 5, 1984 [FR] France ..... 84 16800

[51] Int. Cl.[4] ..... A47H 5/14; E06B 3/94

[52] U.S. Cl. ..... 160/84 R; 160/331

[58] Field of Search ..... 160/84 R, 26, 170, DIG. 17, 160/133, 331, 19, 23 R, 32, 33, 38; 285/41

[56] References Cited

U.S. PATENT DOCUMENTS

| | | | |
|---|---|---|---|
| 2,661,450 | 12/1953 | Moler | 49/199 |
| 3,249,148 | 5/1966 | Zablodil et al. | 160/DIG. 17 |
| 3,308,873 | 3/1967 | Dotto | 160/DIG. 17 |
| 3,705,734 | 12/1972 | Rajakovics | 285/41 |
| 3,878,879 | 4/1975 | Manns | 160/23 R |
| 3,961,659 | 6/1976 | Siegel | 160/26 |
| 4,161,647 | 7/1979 | Carbonnel | 285/41 |
| 4,365,660 | 12/1982 | Henkenjohann | 160/133 |
| 4,531,562 | 7/1985 | Swanson | 160/26 |
| 4,550,759 | 11/1985 | Archer | 160/DIG. 17 |

FOREIGN PATENT DOCUMENTS

| | | | |
|---|---|---|---|
| 2929374 | 1/1981 | Fed. Rep. of Germany | 160/26 |
| 746852 | 3/1933 | France | 160/23 R |
| 1072335 | 3/1954 | France | 160/170 |
| 1155327 | 11/1957 | France | 160/23 R |
| 2410117 | 7/1979 | France | 160/84 R |
| 2425530 | 1/1980 | France | 160/26 |

*Primary Examiner*—Randolph A. Reese
*Assistant Examiner*—Anthony Knight
*Attorney, Agent, or Firm*—Sughrue, Mion, Zinn, Macpeak and Seas

[57] ABSTRACT

The drive mechanism for a concertina-type door, including a motor and stepdown gearbox (1), a shaft (2) for winding up door-lifting belts (15), and an end-of-stroke unit (4), are mounted in a U-shaped metal channel section beam whose open side does not face downwardly and whose web is thus either the bottom horizontal portion of the beam, or else is disposed vertically. The beam (11) is fixed as a lintel at or near the top of door risers (12, 13), and is closed by a removable cover. The inside of the beam is lined with insulating material (16) and is equipped with a thermostatically controlled heater resistance. The beam housing enables the drive components to be maintained and repaired if need be without being removed from the door. It also enables a concertina-type door to operate safely in all weathers, and facilitates manufacture thereof.

3 Claims, 4 Drawing Figures

FIXING AND PROTECTIVE HOUSING FOR THE DRIVE MEANS OF A CONCERTINA TYPE DOOR

The present invention relates to a fixing and protective housing for the drive means of a concertina type door. The drive means include a motor, means for controlling the motor, a shaft for winding up door-lifting belts, an end-of-stroke sensor, and an electrical junction box, etc.

Concertina-type doors are particularly suitable for applications requiring a door of large surface area, as in many industrial installations, warehouses, hangers, etc.

BACKGROUND OF THE INVENTION

In known concertina type doors, the door comprises a horizontally stiff vertically flexible curtain constituted by a series of hinged horizontal panels, or else by a flexible sheet which is stiffened at regular intervals by horizontal stiffener rods. Door-lifting belts each have one end fixed to the bottom of the curtain and the other end fixed to a belt-winding shaft which is rotated under motor control. Preferably, the door-lifting belts pass through guides disposed at intervals up the curtain, e.g. on at least some of the stiffener bars or on at least some of the hinges interconnecting consecutive panels. Each end of the bottom panel (if the door is made of panels), or each end of the bottom stiffener bar and of some of the other stiffener bars (if the door is made of a curtain with stiffener bars), is fitted with a wheel for running along a guide running up the side of the door in the corresponding door riser.

In a conventional embodiment of the belt-winding shaft, the shaft is disposed above the door and rotates in bearings which are fixed to the inside of a metal channel-section bar with the web of the channel section being horizontal and on top, said bar constituting a door lintel. The motor for driving the shaft is fixed along one of the door risers near to the top of the door. The motor shaft is perpendicular to the belt-winding shaft and these two shafts are coupled together by an angle transmission which may also include gear ratio step-down means.

This conventional embodiment suffers from several drawbacks. Firstly, the disposition of the channel-section beam is not entirely satisfactory from the safety point of view, by virtue of its web being on top. It frequently happens in industrial installations that a door of this type is opened and closed several hundred times a day, thereby eventually wearing out and maybe even breaking some of the parts housed in the beam. It can then happen that broken parts, and/or loose nuts or screws, fall out from the beam and that such falling debris can lead to accidents.

Secondly, placing the motor along a door riser makes maintenance, and where necessary repair, difficult. It is often necessary to lower the motor to ground level in order to perform maintenance or repair work thereon.

Finally, if the door is to be used under harsh climatic conditions, it should be observed that nothing is provided to protect the drive means against the effects of condensation and of frost. Freezing condensation may jam some types of mechanical transmission, thereby making the door unusable.

Preferred embodiments of the present invention solve the above-mentioed drawbacks by providing a fixing and protective housing for the drive means of such concerntina type doors.

SUMMARY OF THE INVENTION

In accordance with the invention the drive means for a concertina-type door are located in a rectangular housing which is open along one of its longitudinal faces other than its bottom face. The housing may be placed on top of the door risers, or it may be fixed against the said risers, near the tops thereof.

The housing containing the drive means preferably includes thermal insulation and a heating resistance, which is preferably thermostatically controlled.

A preferred configuration for the housing containing the drive means is a channel-section metal bar which interconnects the door risers, with the web of the channel section either being horizontal and disposed at the bottom of the bar, or else being vertical and running along a side thereof, with the channel section being closed by a removable cover.

BRIEF DESCRIPTION OF THE DRAWINGS

Embodiments of the invention are described by way of example with reference to the accompanying drawings, in which.

DETAILED DESCRIPTION OF THE PREFERRED EMBODIMENTS

Figure 1:
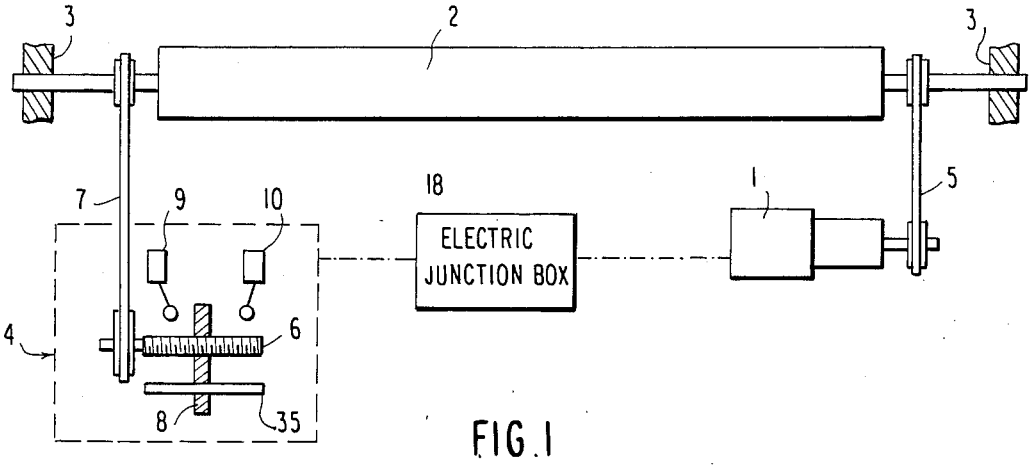
FIG. 1 is a diagram of drive means for a concertina-type door shown without any kind of housing.

FIG. 1 is a diagram showing the drive means of a concertina type door without any housing. The drive means comprise a motor and stepdown gearbox 1, a shaft 2 for winding up door-lifting belts, shaft-supporting bearings 3, and an end-of-stroke sensor unit 4. The motor and gearbox unit 1 has its axis parallel to the belt-winding shaft 2 and drives the shaft via a transmission chain 5. The end-of-stroke unit 4 which serves to stop the motor when the door reaches either of its fully open and its fully closed positions, comprises a screw 6 disposed parallel to the belt-winding shaft 2 and which is driven in rotation by said shaft by means of a second transmission chain 7. A cursor 8 for engaging top and bottom end-of-stroke contacts 9 and 10 which has, for instance, the form of a circular or rectangular plate, includes a threaded hole and a cylindrical hole, whose axes are parallel. The screw 6 cooperates with the threaded hole and a fixed guide rod 35, parallel to the screw 6, passes in the cylindrical hole. The cursor 8 is driven along the screw 6, and moves to the right or to the left depending on the direction of rotation of the belt-winding shaft 2. The end-of-stroke contacts 9 and 10 turn off the supply of electricity to the motor 1 when the cursor comes into contact therewith. The drive means also includes an electric junction box 18.

Figure 2:
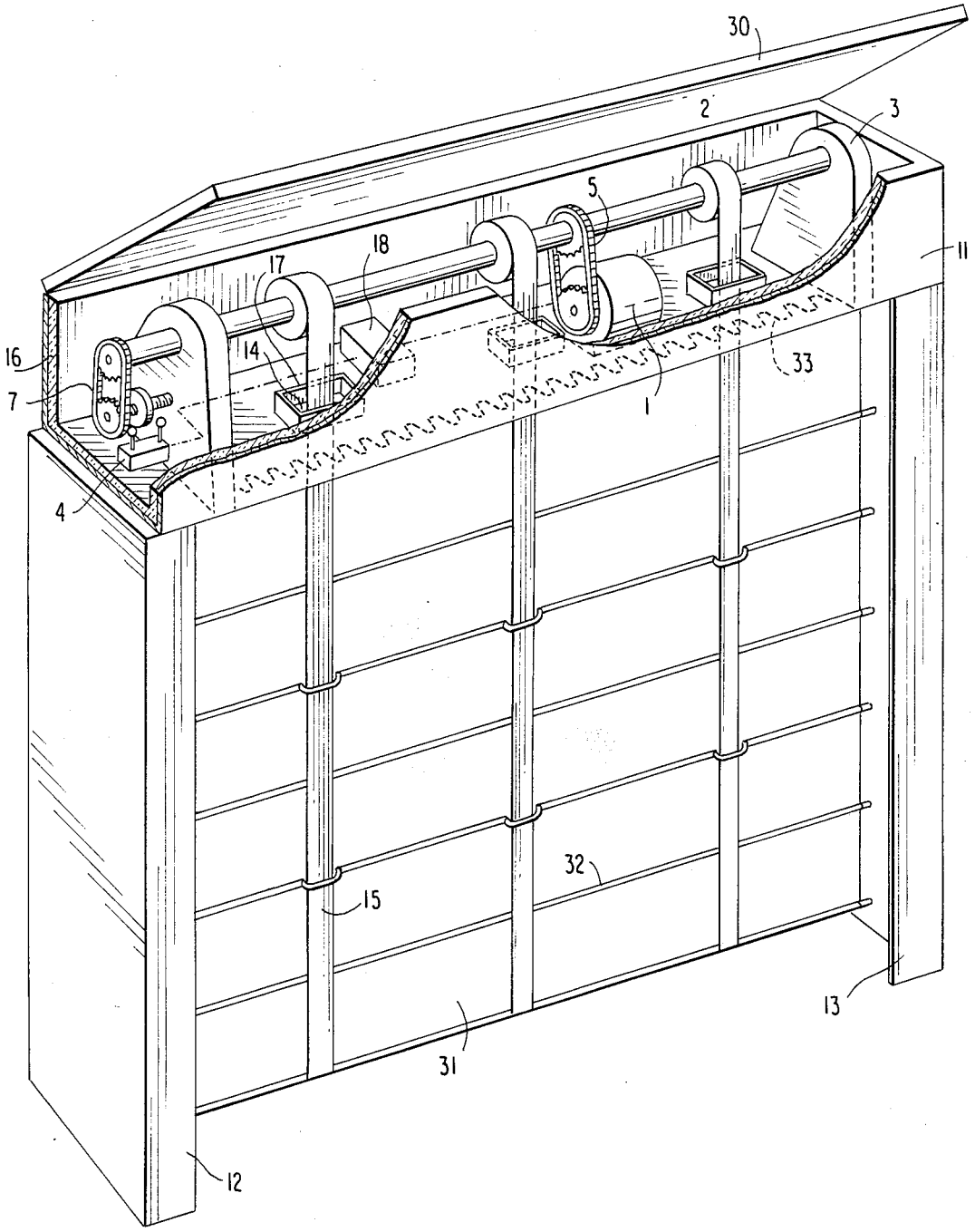
FIG. 2 is a diagrammatic perspective view of drive means for a concertina type door installed in a protective housing situated on top of the door risers in accordance with one embodiment of the invention.

FIG. 2 is a diagrammatic perspective view of a concertina type door with its drive means as described above and mounted inside a metal channel section beam 11 with the web of the channel section being horizontal and disposed at the bottom of the beam. This figure shows the flexible curtain 31 which is stiffened at regular intervals by horizontal stiffener rods 32, the door-lifting belts 15, the motor and gearbox unit 1, the belt-winding shaft 2, the shaft bearings 3, the end-of-stroke unit 4, and the transmission chains 5 and 7. The beam 11 is supported at each end by the risers 12 and 13 of the door. A plurality of rectangular openings 14 are provided through the horizontal web of the beam to pass the door-lifting belts 15. The openings are disposed in parallel with the beam axis, and inside the beam each opening is provided with a rim 17 for preventing small parts of fragments of parts from falling therethrough. The inside of the beam may be lined with insulating material 16. The beam is closed by a removable cover 30 which is preferably hinged on the back edge of the beam 11 and which is likewise lined with insulating material. Both ends of the beam are closed. A heating resistance 33, preferably under thermostatic control, may be located inside the insulated rectangular volume thus defined.

Figure 3:
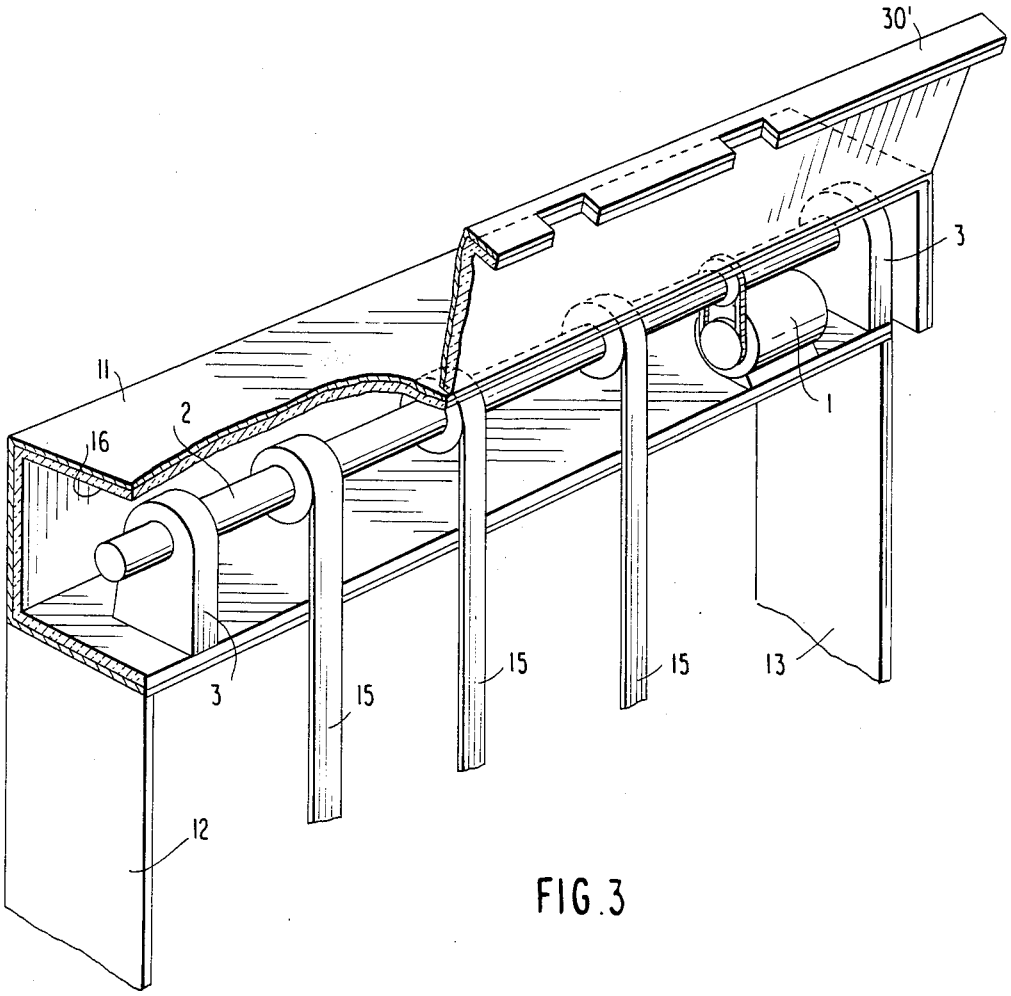
FIG. 3 is a similar view to FIG. 2 showing a second embodiment of the invention.

FIG. 3 is a diagrammatic perspective view of the drive means for a concertina-type door as described in FIG. 1 and fixed inside a metal channel section beam 11 having its web disposed vertically. In this second disposition of the beam, the belts may be passed in two different ways. Either the same solution is used as described with reference to FIG. 2, i.e. rectangular openings are made through the bottom horizontal portion of the beam, or else (and as shown in FIG. 3) the bearings 3 for the belt-winding shaft 2 are so disposed that the belts 15 pass tangentially over the edge of the bottom horizontal flange of the beam. The various parts of the drive means are disposed within the beam in the same manner as described with reference to FIG. 2. The beam 11 may similarly be lined with insulating material 16, and it is closed by a removable vertical cover 30' which is preferably hinged on the upper edge of the channel-section beam 11 and is likewise lined with insulating material, and each of its ends is closed in more permanent manner.

Figure 4:
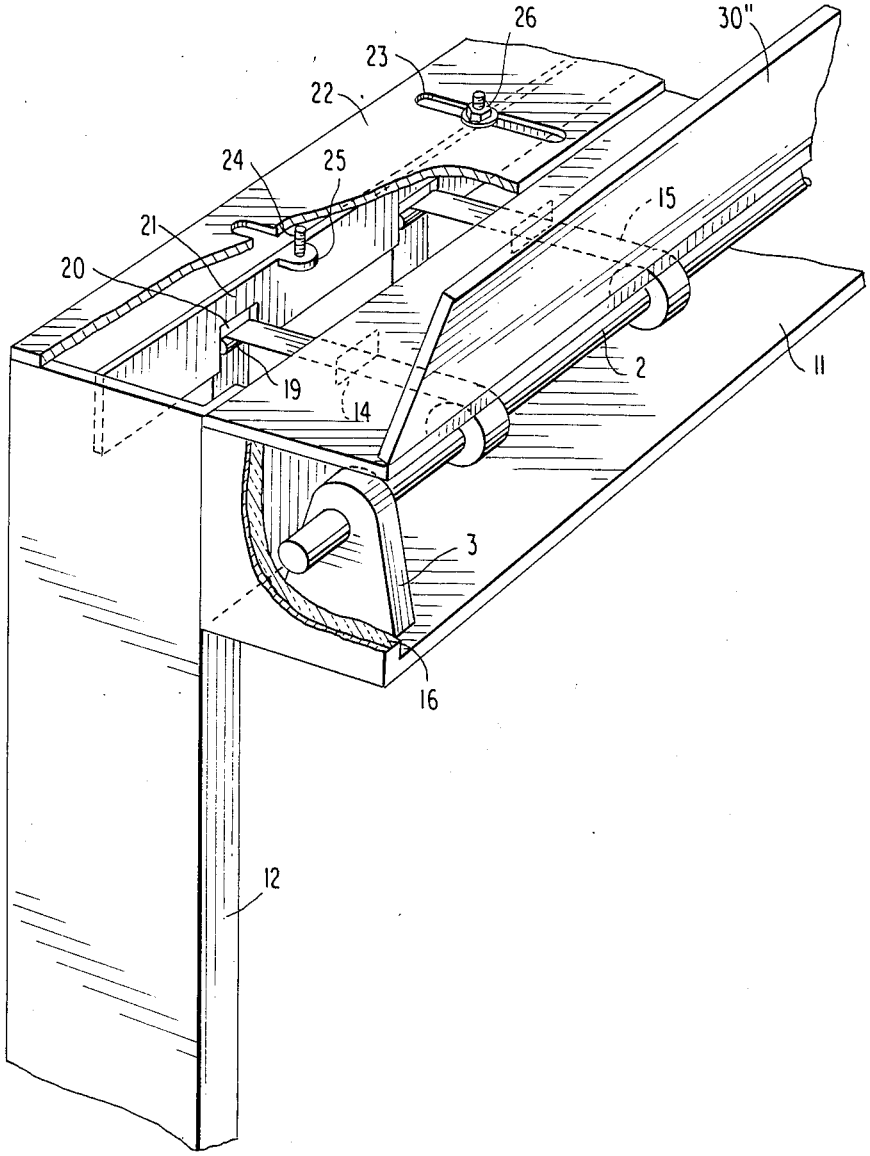
FIG. 4 is a similar view to FIGS. 2 and 3 showing a third embodiment of the invention.

FIG. 4 is a diagrammatic perspective view of a portion of the drive means for a concertina type door placed inside a channel section metal beam 11 (with the web of the channel section being vertical), in which the beam does not rest on top of the risers 12 and 13 of the door as shown in the embodiments described with reference to FIGS. 2 and 3, but is instead fixed against the sides of the risers near their top ends. In this embodiment, the belts 15 extend horizontally over a part of their length and pass through the vertical portion of the channel section beam 11 via rectangular openings 14. Horizontal rolls 19 running parallel to the winding shaft 2 serve to deflect the horizontal translation motion of the belts 15 into vertical motion. These rolls are free to rotate about their axes, and they are received in notches 20 in a vertical plate 21 with each notch retaining the ends of an axle for a corresponding one of the rolls. The vertical plate 21 is fixed to a horizontal plate 22 whose ends rest on the risers 12 and 13. Advantageously, the position of the vertical plate 21 may be adjusted in a direction perpendicular to the winding shaft 2. For example, as shown in FIG. 4, the horizontal plate 22 may include transverse slots 23 for co-operating with bolts 24 which are welded to lugs 25 on the vertical plate 21. The vertical plate 21 is then fixed to the horizontal plate 22 by nuts 26. Such an arrangement has the advantage of enabling the position of the flexible curtain to be modified by displacing the vertical plate 21, and in particular it allows the curtain to be shifted backwards or forwards between the risers 12 and 13, which can be useful for improving draftproofing when the curtain is subjected to a dominant pressure difference tending to urge it outwardly or inwardly.

The position of the drive means within the beam 11, and the lining of the beam are the same as described with reference to FIGS. 2 and 3: the beam 11 may be lined with insulating material 16, and may receive a removable vertical cover 30" which is preferably hinged on the upper edge of the channel section beam 11 and is itself lined with insulating material, and the ends of the beam may be closed in more permanent manner.

Fixing and protective housing for the drive means of a concertina-type door as described above has numerous advantages, including the following:

there is no risk of some part of the drive means falling and causing an accident;

the end-of-stroke unit 4 is protected from misoperation or maladjustment of the type which may occur accidentally when portions of the drive means are not protected;

the motor and gearbox unit or any other part of the drive means may be maintained or repaired, if necessary, without being removed from the door, and all the parts of the drive means are readily accessible;

the possibility of closing the beam and of insulating the rectangular volume therein serves to protect the drive means from dust, and with the addition of a heater resistance, from risks of jamming due to condensation freezing inside the beam under harsh weather conditions;

mass production of concertina type doors is considerably eased since it is possible to prepare and store subassemblies of the drive means which are capable of being very quickly fixed at a later date inside beams which are cut to length according to customer requirements.

The present invention is not limited to the above-described embodiments, and numerous modifications are within the competence of the person skilled in the art.

I claim:

1. A concertina type door installation, comprising:

(a) a pair of horizontally spaced vertical risers (12, 13) interconnected at tops thereof by a metal channel section beam;

(b) a flexible curtain (31) stiffened at regular intervals by a plurality of horizontal, vertically spaced rods (32), said curtain being disposed between said risers;

(c) a plurality of door-lifting belts (15) fixed at lower ends thereof to a bottom rod of the curtain and preferably passing through guides fixed at intervals along the rods;

(d) a belt-winding shaft (2) rotatably disposed above the curtain, upper ends of said belts being fixed to said shaft;

(e) a motor and reduction gear unit (1) for driving the shaft; and (f) an end-of-stroke unit (4) for stopping the motor when the curtain reaches a fully open or a fully closed position;

(g) said metal channel section beam defining a protective housing (11) in the form of an elongate rectangular U-shaped trough internally mounting the belt-winding shaft, the motor and reduction gear unit, and the end-of-stroke unit for the concertina type door, said housing being disposed across upper ends of the risers and being open along one longitudinal face other than a bottom face, (h) wherein the housing includes means (33) for heating an inside of the housing.

2. A concertina type door installation, comprising:

(a) a pair of horizontally spaced vertical risers (12, 13) interconnected at tops thereof by a metal channel section beam;

(b) a flexible curtain (31) stiffened at regular intervals by a plurality of horizontal, vertically spaced rods (32), said curtain being disposed between said risers;

(c) a plurality of door-lifting belts (15) fixed at lower ends thereof to a bottom rod of the curtain and preferably passing through guides fixed at intervals along the rods;

(d) a belt-winding shaft (2) rotatably disposed above the curtain, upper ends of said belts being fixed to said shaft;

(e) a motor and reduction gear unit (1) for driving the shaft; and (f) an end-of-stroke unit (4) for stopping the motor when the curtain reaches a fully open or a fully closed position;

(g) said metal channel section beam defining a protective housing (11) in the form an elongate rectangular U-shaped trough internally mounting the belt-winding shaft, the motor and reduction gear unit, and the end-of-stroke unit for the concertina type door, said housing being disposed across upper ends of the risers and being open along one longitudinal face other than a bottom face, (h) wherein the housing containing drive components is disposed against the risers at upper ends thereof, wherein the belts pass over horizontal rolls (19) which extend parallel to the winding shaft and which are free to rotate about respective horizontal axes, and including means for displacing the rolls parallel to the shaft.

3. A door installation according to claim 2, wherein the rolls are held by a vertical plate (21) fixed to a horizontal plate (22) including transverse slots (23) for cooperating with fixing means (24–26) for said vertical plate.

* * * * *